US009162275B2

(12) United States Patent
Cheng

(10) Patent No.: US 9,162,275 B2
(45) Date of Patent: Oct. 20, 2015

(54) FLARING DEVICE FOR A TUBULAR MEMBER

(71) Applicant: Chieh-Yu Cheng, Taichung (TW)

(72) Inventor: Chieh-Yu Cheng, Taichung (TW)

( * ) Notice: Subject to any disclaimer, the term of this patent is extended or adjusted under 35 U.S.C. 154(b) by 262 days.

(21) Appl. No.: 13/888,366

(22) Filed: May 7, 2013

(65) Prior Publication Data

US 2014/0290327 A1 Oct. 2, 2014

(30) Foreign Application Priority Data

Apr. 2, 2013 (TW) ..... 102111903 A

(51) Int. Cl.
*B21D 41/02* (2006.01)

(52) U.S. Cl.
CPC ..... *B21D 41/021* (2013.01)

(58) Field of Classification Search
CPC .... B21D 41/021; B21D 41/02; B21D 41/025; B21D 39/08
USPC ..... 72/370.06–370.08, 393, 453.01, 453.16
See application file for complete search history.

(56) References Cited

U.S. PATENT DOCUMENTS

| | | | | |
|---|---|---|---|---|
| 3,888,102 | A * | 6/1975 | Nigido | 72/393 |
| 4,494,398 | A * | 1/1985 | Svoboda | 72/393 |
| 6,619,099 | B2 * | 9/2003 | Barjesteh | 72/393 |

* cited by examiner

*Primary Examiner* — Teresa M Ekiert

(57) ABSTRACT

A flaring device for flaring a hollow malleable tubular member is provided. A hydraulically powered assembly includes a main body having a cylinder, a lever and a piston member which is received in the cylinder. The main body has an axis and opposing first end and second end. The lever is pivoted on the first end of the main body and operable to drive the piston member to move along the axis. One end of the piston member is formed with a conical expander. The die set is disposed at the second end of the main body and has a plurality of die elements arranged around the axis. The conical expander of the piston member is actuated to move axially and outwardly so as to radially drive the die elements to flare the hollow malleable tubular member.

10 Claims, 9 Drawing Sheets

FLARING DEVICE FOR A TUBULAR MEMBER

BACKGROUND OF THE INVENTION

1. Field of the Invention

The present invention relates to a flaring device for a tubular member.

2. Description of the Prior Art

A conventional flaring device is used to flare one end of a tubular member, so that an opening of the tubular member would be flared and expanded. Thus, the flared tubular members could be connected to each other conveniently.

The conventional flaring device has two opposing conical clipping member disposed thereon. A plurality of expanders is arranged around a periphery of the conical clipping member. A user could operate the conventional flaring device to reduce a distance between the two conical clipping members, so that a conical surface of the conical clipping member would push the expanders to move outwardly for flaring and expanding an internal wall of the tubular member.

Clearly, the conventional flaring device includes a screw rod is movably screwed between the two conical clipping members. The two conical clipping members would be approached to or away from each other via rotating the screw rod. When the screw rod is rotated, one conical clipping member is moved by said rotation; another conical clipping member is rotated relative to the screw rod, so that the two conical surfaces are rotated relative to each other. However, the conventional flaring device is inconveniently to operate, and said rotation of the screw rod for the two conical clipping members to approach to or be away from each other, is laborious and tardy. Therefore, the two conical surfaces rotated relative to each other would apply a torsion onto the two expanders to cause a non-uniform expansion.

A further conventional flaring device includes a body having a handle bar disposed thereon. By using the lever rule, the handle bar could drive a conical faring pusher to move outwardly for flaring a tubular member. However, the further conventional flaring device could be only operated by applying a hand press. Regardless of the thickness of the tubular member, a user needs to apply a strong force to drive the further conventional flaring device. Therefore, a flaring efficiency of the further conventional flaring device is bad, and if the tubular member has a thick tubular wall, the thick tubular wall could not be flared.

The present invention is, therefore, arisen to obviate or at least mitigate the above mentioned disadvantages.

SUMMARY OF THE INVENTION

An object of the present invention is to provide a flaring device for a tubular member, in which the flaring device could provide a proper handle length for a user to operate or effort easily so as to get a better flaring efficiency. Furthermore, the flaring device is convenient for the user to detach, replacement, repair, produce and store. Moreover, the flaring device could prevent a flaring portion of the tubular member from non-uniformly being flared for avoiding an irregularly flaring result. Thus, the flaring device could provide variable flaring sizes for the tubular member, or/and selectively to flare the tubular member gradually.

To achieve the above and other objects, a flaring device for flaring a hollow malleable tubular member is provided. The tube flaring device includes a hydraulically powered assembly and a die set. The hydraulically powered assembly includes a main body having a cylinder, a lever and a piston member which is received in the cylinder. The main body has an axis and opposing first end and second end located on the axis. The lever is traverse to a direction in which the axis extends and pivoted on the first end of the main body, and the lever is operable to drive the piston member to move along the axis. One end of the piston member is formed with a conical expander. The die set is disposed at the second end of the main body and has a plurality of die elements arranged around the axis. The conical expander of the piston member is actuated to move axially and outwardly so as to radially drive the die elements to flare the hollow malleable tubular member.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
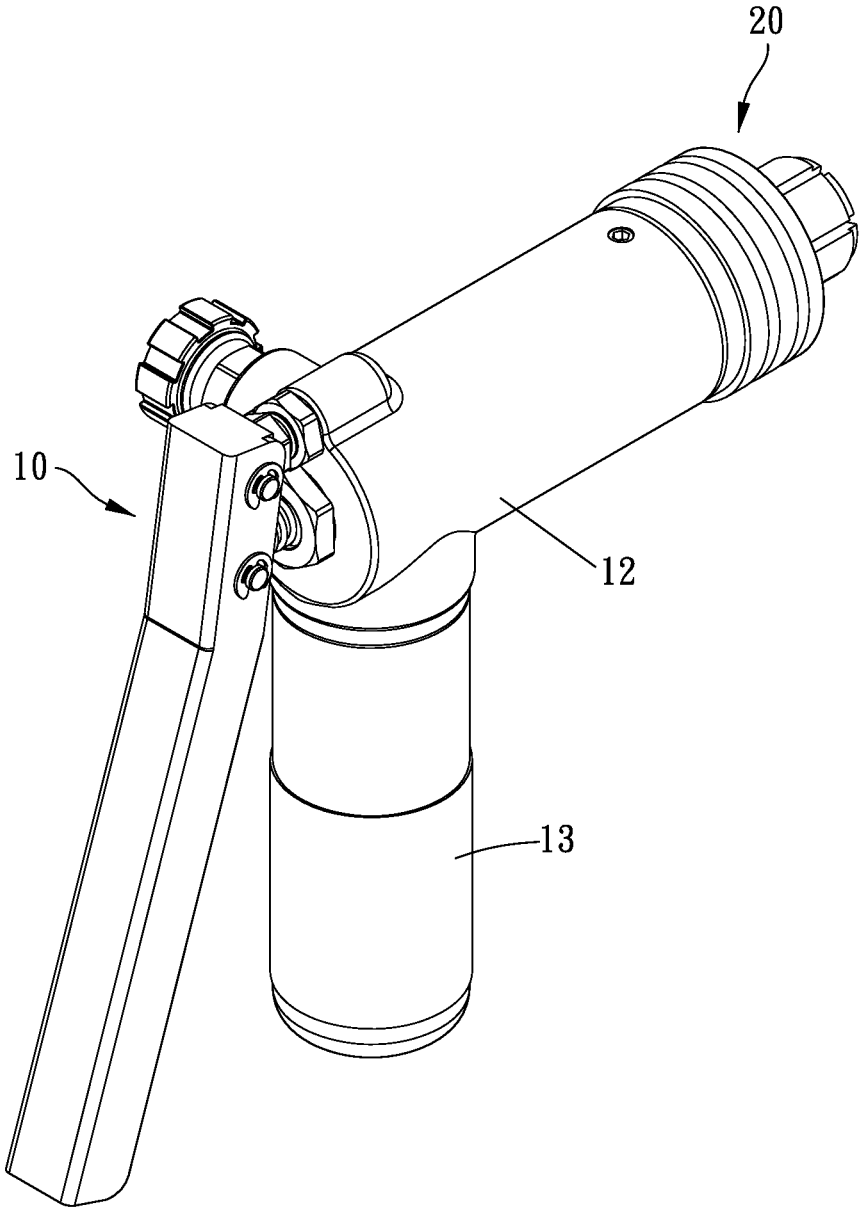
FIG. 1 is a perspective view of a first embodiment of a flaring device according to a preferred embodiment of the present invention.
Figure 2:
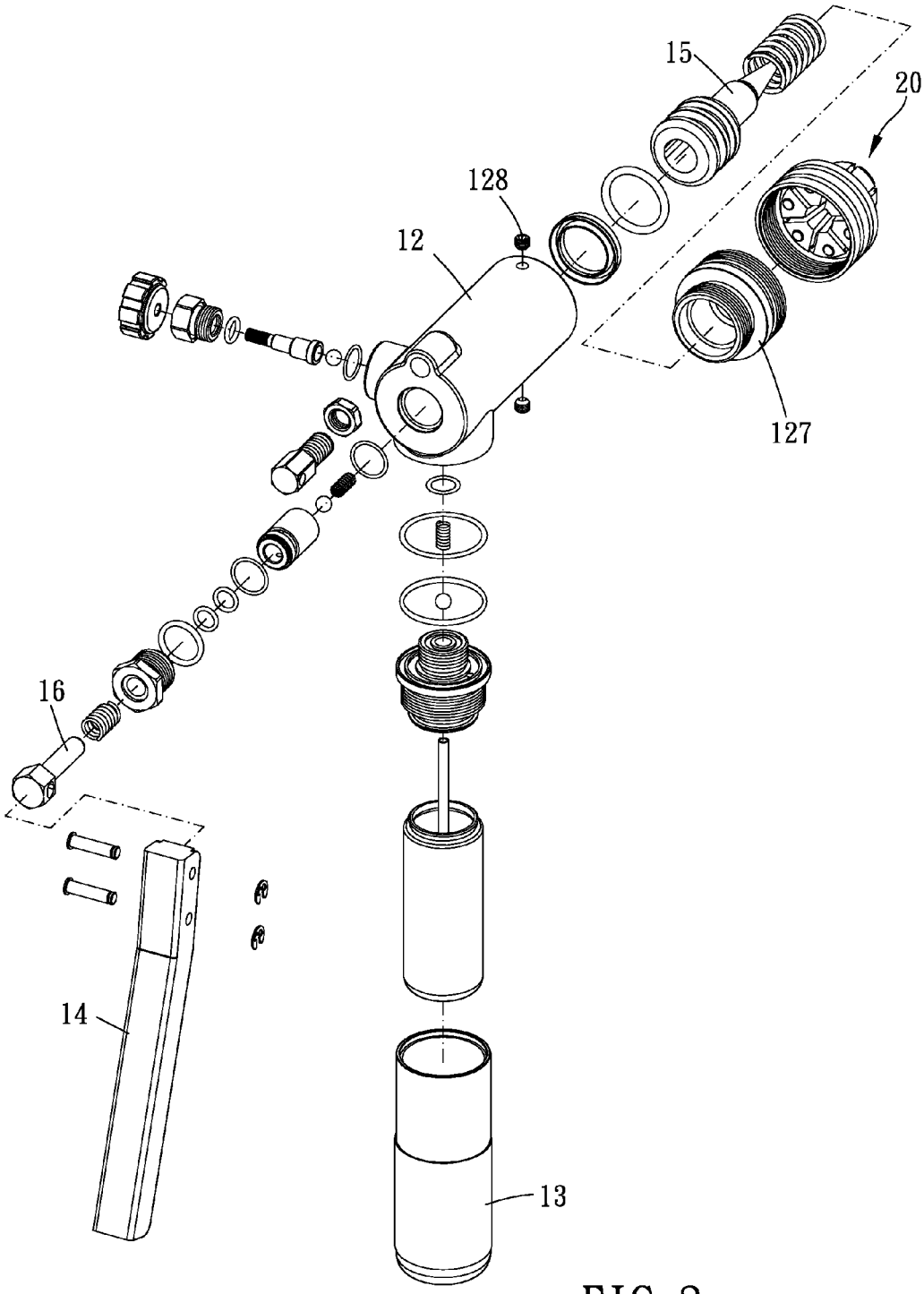
FIG. 2 is an exploded perspective view of the present invention.
Figure 3:
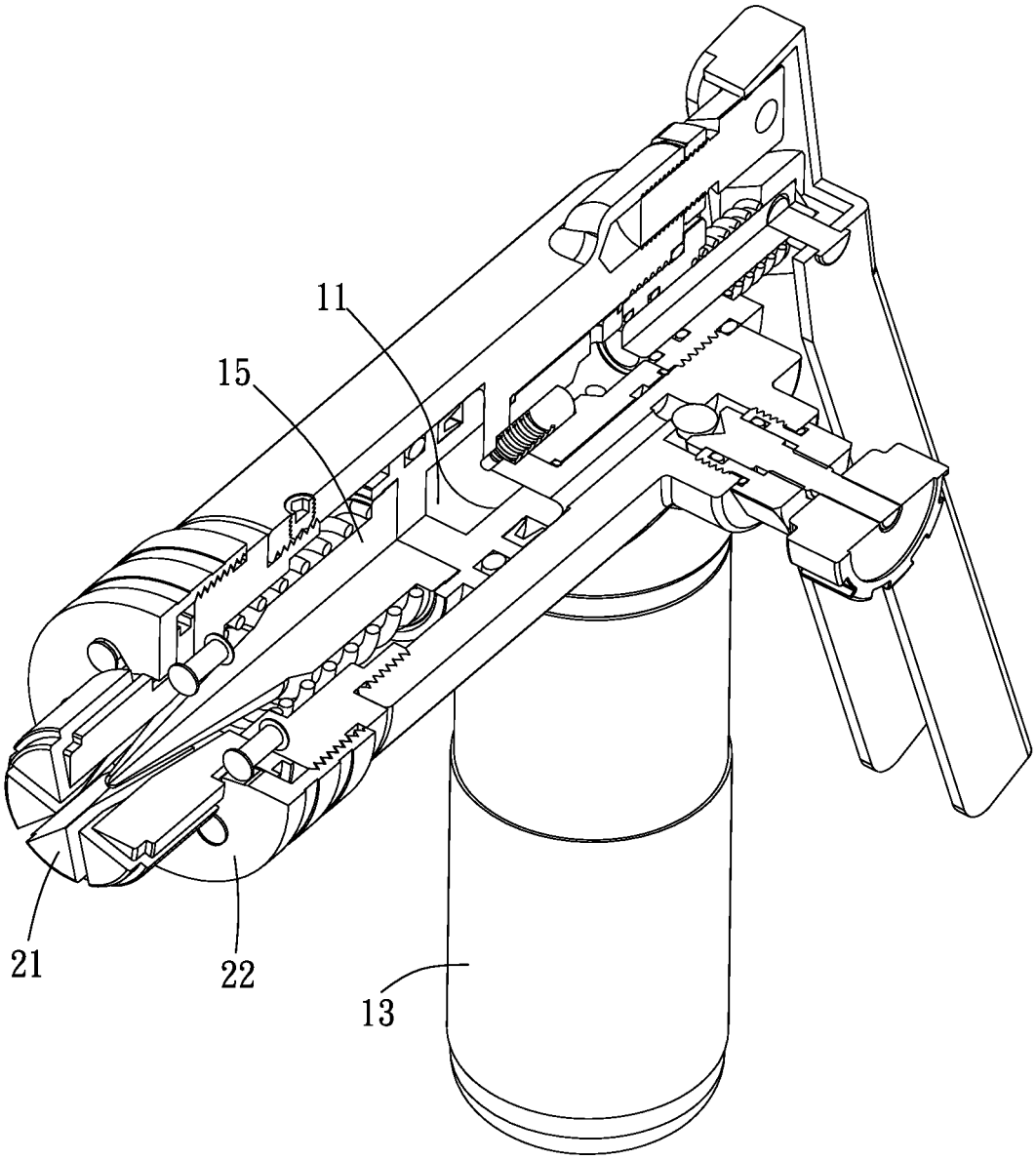
FIG. 3 is a partial perspective view of the present invention.

FIGS. 1-4 show a flaring device according to a preferred embodiment of the present invention. The flaring device is used to flare a hollow malleable tubular member and includes a hydraulically powered assembly 10 and a die set 20.

The hydraulically powered assembly 10 includes a main body 12 having a cylinder 11, a liquid container 13, a lever 14 and a piston member 15 received in the cylinder 11.

The main body 12 has an axis 121, a first end 122 and a second end 123. The first end 122 and the second end 123 are located on the axis 121 and are opposite to each other. The liquid container 13 is traverse to a direction in which the axis 121 extends (such as vertical to the axis 121) and radially extended from the main body 12, so that the flaring device could provide a proper hold length for operating with one hand. Clearly, the liquid container 13 controllably communicates with the cylinder 11 in fluid flowing relationship. A fluid passage 124 is formed between the cylinder 11 and the liquid container 13. A first unidirectional valve 125 which is adjacent to the cylinder 11 and a second unidirectional valve 126 which is adjacent to the liquid container 13 are both disposed at the fluid passage 124. A pressed liquid could selectively flow into the cylinder 11 or not, via operating the first unidirectional valve 125 and the second unidirectional valve 126.

Preferably, the liquid container 13 is detachably assembled to the main body 12 for a user to detach, replace, repair, produce or store conveniently. The liquid container 13 could be integrated with the main body 12.

The second end 123 of the main body 12 has a connecting portion 127 non-rotatably assembled to the cylinder 11. The die set 20 is disposed on one end of the connecting portion 127. Clearly, an external screw portion 1271 is formed on one end of the connecting portion 127. An internal screw portion 111 is formed on an internal wall of the cylinder 11. The external screw portion 1271 is screwed to the internal screw portion 111. At least one fastener 128 (such as a bolt) is radially screwed through the internal screw portion and abutted against the external screw portion, so that the connecting portion 127 could not be rotated relative to the cylinder 11. Therefore, the connecting portion 127 is prevented from being moved easily and influencing a relative positioning of the die set 20 to the axis 121. Conceivably, a connecting mode between the connecting portion 127 and the cylinder 11 is not limited by above description. For example, the connecting portion 127 could be screwed at an external position of the cylinder 11 or the connecting portion 127 could be fixedly welded to the cylinder 11.

The lever 14 is traverse to the axis 121 (the lever 14 would be inclined relative to the axis 121 for the user to smoothly press the lever 14). One end of the lever 14 is pivoted on the first end 122 of the main body 12, so that the user could conveniently operate the lever 14 (such as pressed with one hand) for a better flaring efficiency. The lever 14 is operable to drive the piston member 15 to move along the axis 121. One end of the piston member 15 is formed with a conical expander 151. Clearly, the lever 14, is obliquely extended from the first end 122 of the main body 12 and is gradually distant from the liquid container 13. One end of a recoverable plunger 16 is pivoted on the lever 14 and another end of the plunger 16 is inserted into an active passage 129 of the first end 122 of the main body 12. The active passage 129 communicates with the fluid passage 124. The plunger 16 is used to press the pressed liquid into the cylinder 11.

In the present embodiment, the piston member 15 includes a plug portion 152 and a body portion 153 extended from the plug portion 152 toward the die elements 20. The conical expander 151 is integrated with the body portion 153 or detachably assembled to the body portion 153. The plug portion 152 is detachable from the body portion 153 (such as fastening or screwing, but not being limited as above) for the user to detach, replace, repair, produce and store conveniently. The plug portion 152 could be integrated with the body portion 153 in other embodiment of the present invention.

The plug portion 152 is entirely received within the main body 12 and the body portion 153 extends from the plug portion 152 toward the die elements 20. The conical expander 151 is disposed on the body portion 153. The plug portion 152 includes first and second recesses 154, 155 at opposite ends thereof along the axis 121, the body portion 153 is detachably assembled in the first recess 154 within the main body 12, and the second recess 155 is open toward the first end 122. The first recess 154 has a depth less than that of the second recess 155, and the first recess 154 has a width greater than that of the second recess 155.

Figure 5:
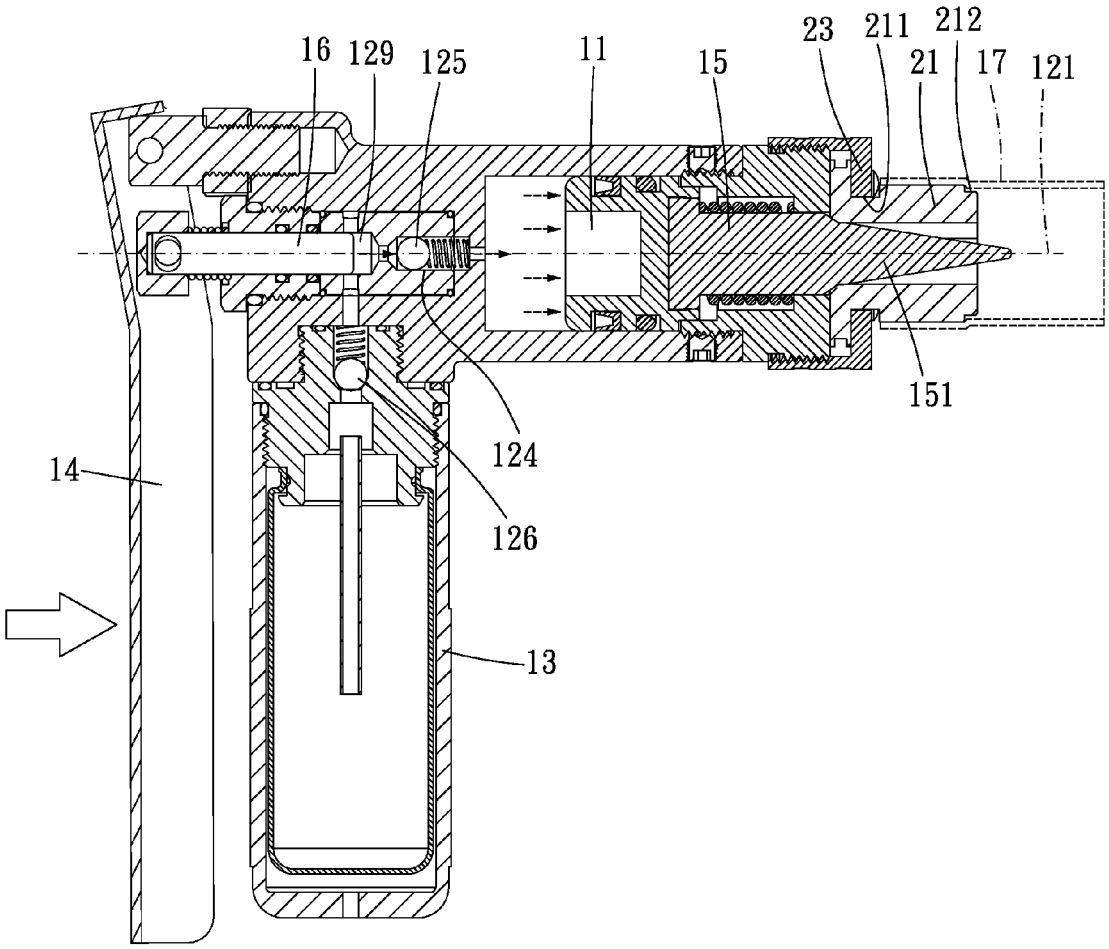
FIGS. 5-6 are cross-sectional views of the present invention for showing the flaring device is operated.
Figure 6:
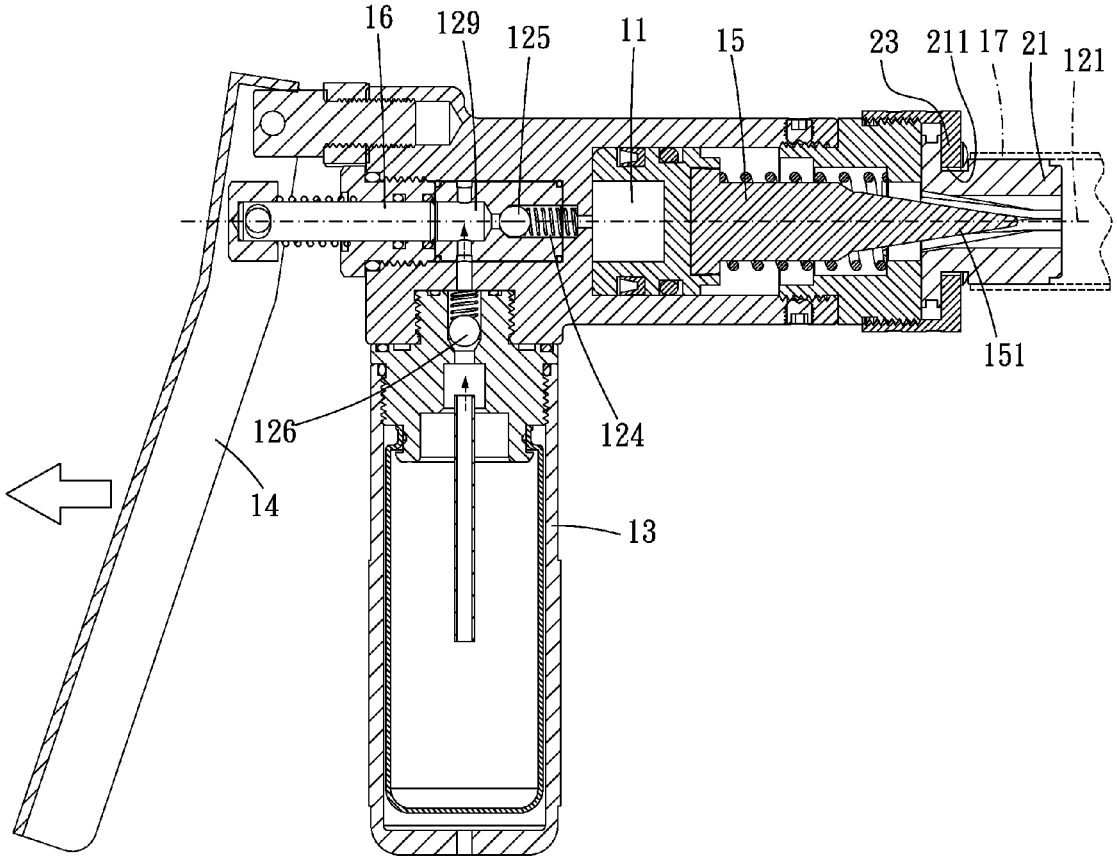

Referring to FIGS. 5-6, the user could once or repeatedly press the lever 14 toward the liquid container 13 for driving the plunger 16 to move toward the cylinder 11. The plunger 16 presses the pressed liquid in the active passage 129 and the fluid passage 124 to open the first unidirectional valve 125, so that the pressed liquid is allowed to flow into the cylinder 11. Thereafter, the pressed liquid pushes the piston member 15 to move toward the die element 21, and the conical expander 151 of the piston member 15 would outwardly move to radially push the die elements 21 for flaring the hollow malleable tubular member 17. When the lever 14 and plunger 16 is pushed by a spring to recover, the plunger 16 would backwardly move and form an attract force to open the second unidirectional valve 126, so that the liquid is flowed from the liquid container 13 into the active passage 129 and the fluid passage 124 for resupplying. Therefore, the user could operate the present invention again.

Owing to the recess 211 is formed on the periphery of each die element 21 and at least one portion of the annular wall 23 is extended radially inwardly into the recess 211, so that the die elements 21 would not be easily moved or escaped from the die element supporter 22 before starting a flaring work. In the process of the flaring work, the recess 211 corresponds to the annular wall 23, so that the die elements 21 would not easily be moved and the die elements 21 would not be swung relative to the axis 121 so as to avoid a flaring segment of the hollow malleable tubular member 17 being uniformly flared.

Figure 7:
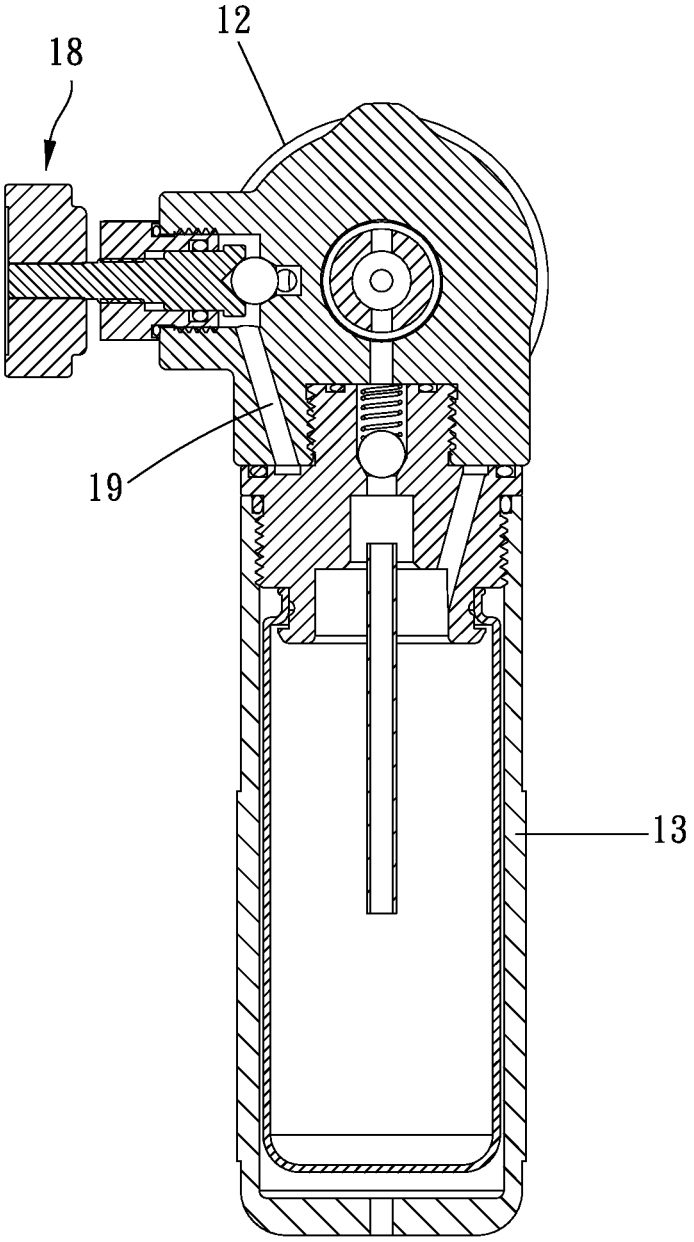
FIG. 7 is a cross-sectional view of the present invention for showing an oil-return passage is communicated with a liquid container.
Figure 8:
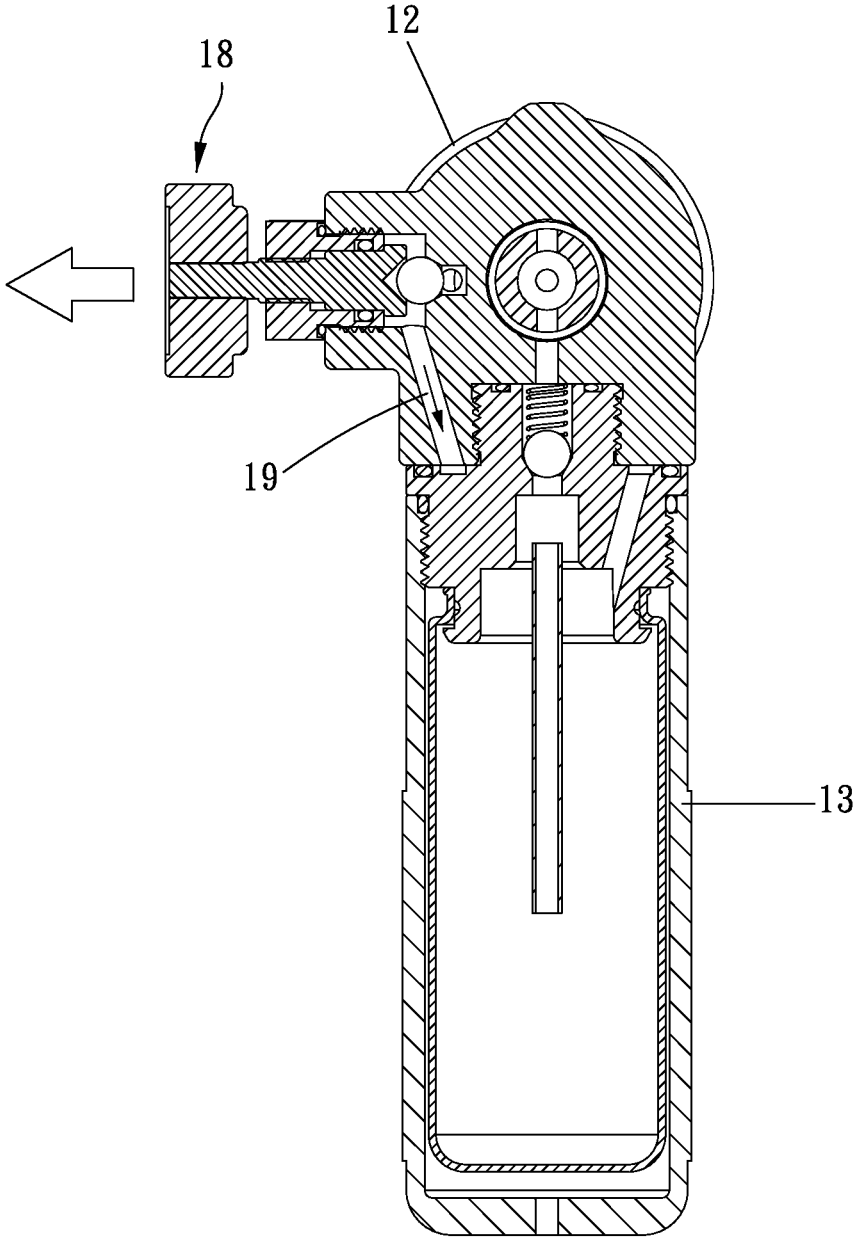
FIG. 8 is a cross-sectional view of the present invention for showing a liquid flows from the oil-return passage to the liquid container.

Referring to FIGS. 7-8, when finishing the flaring work, a control assembly 18 which disposed on the main body 12 could drive the cylinder 11 to communicate with the liquid container 13 via an oil-return passage 19, so that a pressure of the cylinder 11 is released for returning the piston member 15 (such as via a spring). Thereafter, the die elements 21 could be inwardly moved to be escaped from the hollow malleable tubular member 17. Conceivably, the control assembly 18 could be any valve structures, and the control assembly 18 could include a plurality of functions to limit the lever 14, the piston member 15, plunger 16, the first unidirectional valve 125, or/and the second unidirectional valve 126.

Figure 9:
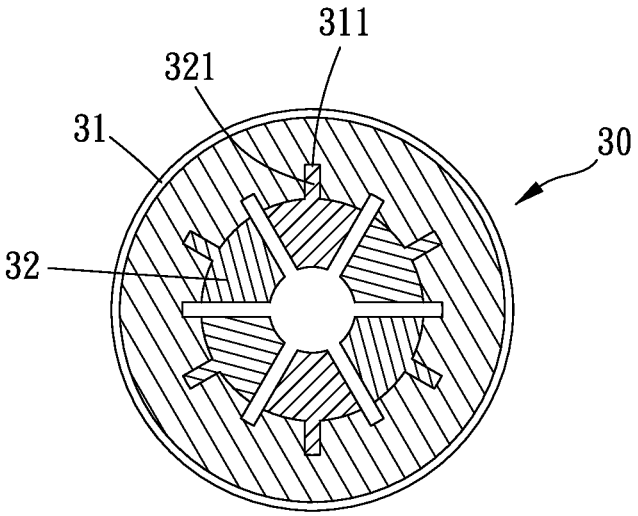
FIG. 9 is a cross-sectional view of a second embodiment of the present invention.
Figure 10:
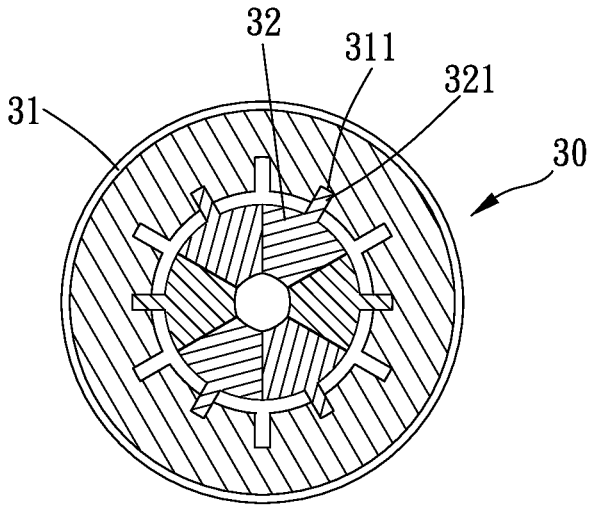
FIG. 10 is a cross-sectional view of a third embodiment of the present invention.

Referring to FIGS. 9-10, a second and a third embodiment show that at least one first positioning structure 311 is disposed on a periphery of a further through hole of a further die element supporter 31 of a further die set 30. At least one of a plurality of die elements 32 of the die set 30 has at least one second positioning structure 321 disposed radially thereon. The first positioning structure 311 corresponds to the second positioning structure 321, and the first positioning structure 311 and the second positioning structure 321 are circumferentially limitably movable and blockable via abutting against with each other.

In the second and third embodiments of the present invention, a plurality of first positioning structures 311 is uniformly arranged along the further through hole of the further die element supporter 31. The first positioning structures 311 are radially formed grooves. Each further die element 32 has the second positioning structure 321 formed on the periphery thereof, and the second positioning structure 321 is a rib panel which has a thickness corresponded to a width of the groove. Preferably, the grooves are sorted as a plurality of equiangular arranged groups. The grooves of each group have a same radial depth, and the grooves of different groups have a different radial depth. When the rib panels are abutted against the corresponded grooves of one group, a plurality of constructional circles which have a one diameter is formed on the periphery of the further die elements 32; when the rib panels are abutted against the corresponded grooves of another group, a plurality of constructional circles which have an another diameter is formed on the periphery of the further die elements 32. Referring to FIG. 9, the radial depth of the groove is equal to the thickness of the rib panel (or a little larger than the thickness of the rib panel), so that the periphery of the further die element 32 is able to be abutted against the periphery of the further die element supporter 31. Therefore, the constructional circle which is formed on the periphery of the further die element 32 has a longer diameter. Referring to FIG. 10, the radial depth of the groove is smaller than the thickness of the rib panel. When the rib panel is abutted against a bottom of the corresponded groove, a distance is formed between the periphery of the further die element 32 and the periphery of the further die element supporter 31, so that the constructional circle which is formed on the periphery of the further die element 32 has a shorter diameter. Thus, the present invention could provide variant flaring levels or/and choose gradual-flaring efficiency via plugging the rib panels into the grooves of the different groups.

Figure 4:
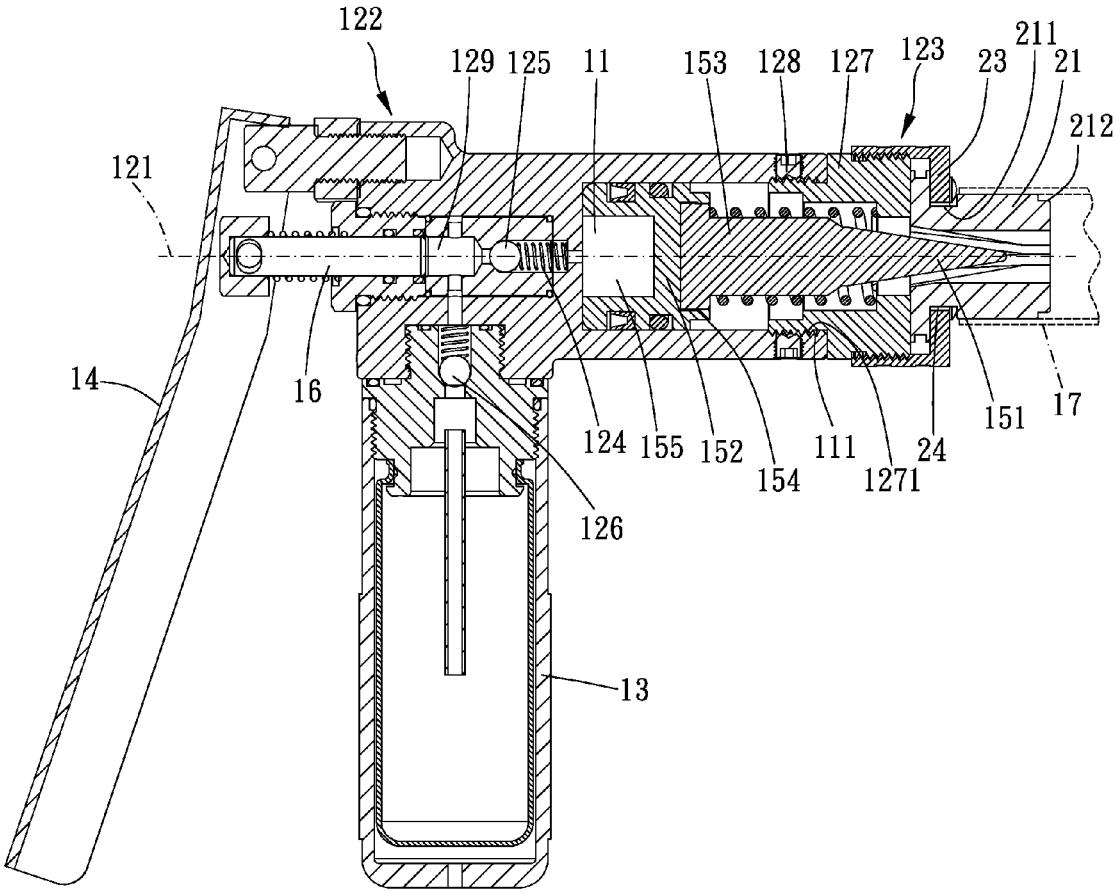
FIG. 4 is a cross-sectional view of the present invention for showing an oil-return passage is communicated with a liquid container.

Referring to FIGS. 4-5, the radial tapered portion 212 is formed on the periphery of one end of each die element 21 which is remote from the main body 12. Preferably, the radial tapered portion 212 is formed as smooth arc-shaped, so that the hollow malleable tubular member 17 would not be damaged by the radial tapered portion 212, and a transitional portion between a flaring portion and a non-flaring portion of the hollow malleable tubular member 17 would not be damaged or/and reduce a structure strength by a punchy flaring force. Moreover, the die element 21 would not be jammed to the hollow malleable tubular member 17, so that the die element 21 could be easily removed from the hollow malleable tubular member 17 after the flaring work.

Under above arrangement, the liquid container 13 is traverse to the axis 121 and extended from the main body 12, and/or the lever 14 is traverse to the axis 121 and pivoted to the main body 12, so that the flaring device could provide a proper hold length for operating, and the user could conveniently operate the lever 14 for a better flaring efficiency.

Besides, the liquid container 13 is detachable from the main body 12 for a user to detach, replace, repair, produce and store conveniently.

The conical expander 151 is integrated with the body portion 153 or detachable from the body portion 153, or/and the plug portion 152 is detachable from the body portion 153 for the user to detach, replace, repair, produce and store conveniently.

The recess 211 is formed on a periphery of each die element 21, and the annular wall 23 is at least partially extended into the recess 211. In the process of the flaring work, the recess 211 corresponds to the annular wall 23; the die elements 21 would not be easily moved, and the die elements 21 would not be swung relative to the axis 121, so as to avoid a flaring segment of the hollow malleable tubular member 17 being uniformly flared.

Furthermore, the first positioning structure 311 and the second positioning structure 321 are respectively formed on the further through hole of the further die element supporter 31 and the further die element 32, so that the present invention could provide variant flaring levels or/and choose gradual-flaring efficiency Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A flaring device for flaring a hollow malleable tubular member comprising:

a hydraulically powered assembly including a main body having a cylinder, a lever and a piston member which is received in the cylinder, the main body having an axis and opposing first end and second end located on the axis, the lever being traverse to a direction in which the axis extends and pivoted on the first end of the main body, the lever being operable to drive the piston member to move along the axis, one end of the piston member being formed with a conical expander; and a die set disposed at the second end of the main body and having a plurality of die elements arranged around the axis;

wherein, the conical expander of the piston member is actuated to move axially and outwardly so as to radially drive the die elements to flare the hollow malleable tubular member;

wherein the piston member includes a plug portion which is entirely received within the main body and a body portion extended from the plug portion toward the die elements; the conical expander is disposed on the body portion;

wherein the plug portion includes first and second recesses at opposite ends thereof along the axis, the body portion is detachably assembled in the first recess within the main body, and the second recess is open toward the first end.

2. The flaring device as claimed in claim 1, wherein the hydraulically powered assembly includes a liquid container being traverse to the axis and extended from the main body; the liquid container controllably communicates with the cylinder in fluid flowing relationship.

3. The flaring device as claimed in claim 2, wherein the liquid container is detachable from the main body.

4. The flaring device as claimed in claim 1, wherein the second end of the main body has a connecting portion non-rotatably assembled to the cylinder; the die set is disposed at one end of the connecting portion.

5. The flaring device as claimed in claim 4, wherein an external screw portion is formed on one end of the connecting portion, an internal screw portion is formed on an internal wall of the cylinder, at least one fastener is radially screwed through the internal screw portion and abutted against the external screw portion.

6. The flaring device as claimed in claim 1, wherein the die set includes a die element supporter; the die element supporter is connected to the second end of the main body and has a through hole opened thereon; the die elements are clipped between the main body and the die element supporter; the die elements are radially movable and pass through the through hole.

7. The flaring device as claimed in claim 6, wherein at least one first positioning structure is disposed on a periphery of the through hole; at least one of the die elements has at least one second positioning structure disposed radially thereon; the first positioning structure corresponds to the second positioning structure, and the first positioning structure and the second positioning structure are circumferentially limitably movable and blockable via abutting against with each other.

8. The flaring device as claimed in claim 1, wherein the die set has an annular wall extended radially inwardly; a recess is formed on a periphery of each die element; the annular wall is at least partially extended into the recess.

9. The flaring device as claimed in claim 1, wherein a radial tapered portion is formed on a periphery of one end of each die element which is remote from the main body.

10. The flaring device as claimed in claim 1, wherein the first recess has a depth less than that of the second recess, and the first recess has a width greater than that of the second recess.

* * * * *